US005895504A

United States Patent [19]

Sramek et al.

[11] Patent Number: 5,895,504

[45] Date of Patent: Apr. 20, 1999

[54] METHODS FOR USING A FABRIC WIPE

[75] Inventors: John A. Sramek, Village of Wind Point; Thomas A. Strash, Kenosha, both of Wis.

[73] Assignee: S. C. Johnson & Son, Inc., Racine, Wis.

[21] Appl. No.: 08/891,850

[22] Filed: Jul. 9, 1997

[51] Int. Cl.[6] ..... G06L 1/04

[52] U.S. Cl. ..... 8/137; 8/142; 510/278; 510/280; 510/281; 510/283; 510/284; 510/285; 510/291; 510/295; 510/405; 510/406; 510/407; 510/411; 442/153; 442/165; 428/221

[58] Field of Search ..... 8/137, 142; 510/278, 510/280, 281, 283, 284, 285, 291, 295, 405, 406, 407, 411; 442/153, 165; 15/104.93; 428/221

[56] References Cited

U.S. PATENT DOCUMENTS

| | | | |
|---|---|---|---|
| Re. 31,885 | 5/1985 | Meitner . | |
| 2,947,016 | 8/1960 | Thompson . | |
| 2,969,626 | 1/1961 | Rudes . | |
| 2,999,265 | 9/1961 | Duane et al. . | |
| 3,124,825 | 3/1964 | Iovenko . | |
| 3,129,811 | 4/1964 | Williams . | |
| 3,499,575 | 3/1970 | Rockefeller . | |
| 3,533,533 | 10/1970 | Chaney, Jr. . | |
| 3,534,887 | 10/1970 | Ginsberg . | |
| 3,561,456 | 2/1971 | Stuart, Jr. . | |
| 3,567,118 | 3/1971 | Shepherd et al. . | |
| 3,624,224 | 11/1971 | Wei et al. . | |
| 3,818,533 | 6/1974 | Scheuer . | |
| 3,965,518 | 6/1976 | Muoio . | |
| 3,965,519 | 6/1976 | Hermann . | |
| 4,145,302 | 3/1979 | Doan . | |
| 4,189,395 | 2/1980 | Bland . | |
| 4,328,279 | 5/1982 | Meitner et al. . | |
| 4,336,024 | 6/1982 | Denissenko et al. . | |
| 4,372,867 | 2/1983 | Taragos . | |
| 4,409,116 | 10/1983 | Lodico . | |
| 4,428,477 | 1/1984 | Cristofolo . | |
| 4,448,704 | 5/1984 | Barby et al. . | |
| 4,565,644 | 1/1986 | Smith et al. . | |
| 4,600,620 | 7/1986 | Lloyd et al. . | |
| 4,601,938 | 7/1986 | Deacon et al. . | |
| 4,624,890 | 11/1986 | Lloyd et al. . | |
| 4,666,621 | 5/1987 | Clark et al. . | |
| 4,666,624 | 5/1987 | Clark et al. | 15/104.93 |
| 4,673,523 | 6/1987 | Smith et al. . | |
| 4,683,001 | 7/1987 | Floyd et al. . | |
| 4,725,489 | 2/1988 | Jones et al. . | |
| 4,753,844 | 6/1988 | Jones et al. | 442/165 |
| 4,772,501 | 9/1988 | Johnson et al. . | |
| 4,784,786 | 11/1988 | Smith et al. . | |
| 4,833,003 | 5/1989 | Win et al. . | |
| 4,891,265 | 1/1990 | Samagalsky . | |
| 4,998,984 | 3/1991 | McClendon . | |
| 5,037,485 | 8/1991 | Chromecek et al. . | |
| 5,342,534 | 8/1994 | Skrobala et al. . | |
| 5,344,007 | 9/1994 | Nakamura et al. . | |
| 5,507,968 | 4/1996 | Palaikis . | |
| 5,547,476 | 8/1996 | Siklosi et al. | 8/142 |
| 5,595,786 | 1/1997 | McBride, Jr. et al. . | |

FOREIGN PATENT DOCUMENTS

| | | |
|---|---|---|
| 94/16051 | 7/1994 | WIPO . |
| 97/00992 | 1/1997 | WIPO . |
| 98/05814 | 2/1998 | WIPO . |

OTHER PUBLICATIONS

*Johnson European Fabric Wipe Formulation*, (Date Unknown).

*Primary Examiner*—Alan Diamond
*Attorney, Agent, or Firm*—David J. Houser

[57] ABSTRACT

Disclosed herein are methods for use of a towelette to clean stains from clothing and upholstery. The towelette is impregnated with a cleaning solution that is primarily water, but also contains a volatile cleaning agent and a surfactant. The pH and surfactant concentrations of the cleaning solution are regulated. The wipe reduces the incidence of readily visible rings around treated stains.

13 Claims, No Drawings

METHODS FOR USING A FABRIC WIPE

CROSS-REFERENCE TO RELATED APPLICATION

Not applicable.

STATEMENT REGARDING FEDERALLY SPONSORED RESEARCH

Not applicable.

BACKGROUND OF THE INVENTION

This invention relates to wipes useful for removing stains from clothing, upholstery or the like. More particularly, it relates to the use of wipes to remove such stains without leaving a ring.

Pre-moistened wipes have been used to clean various hard surfaces. See e.g. U.S. Pat. No. 4,666,621. The disclosure of this patent and of all other publications referred to herein are incorporated by reference as if fully set forth herein. Such wipes have also been used to clean human skin (e.g. baby wiping products; after meal cleanup products). Such products typically contain water and alcohol to assist in drying the surface being cleaned. Some also contain a surfactant.

However, cleaning spots that are on clothing or upholstery presents a more difficult challenge. When the fabric is immersed in a cleaning solution and entirely wetted, the stain can be mobilized, and the staining material and cleaning solution can then be rinsed away. This is the standard technique used in automated clothes washers. This process can be assisted by pre-treating the stain with a stain remover.

In a number of situations this type of cleaning is impractical for clothing. For example, when traveling one may not have access to an automated washer or dryer, or the time to use them. Moreover, upholstery often cannot easily be removed from furniture for immersion type cleaning.

Another approach is to remove most of the staining material with an absorbent paper towel or the like (e.g. picking off chunks of food). One then applies a cleaning solution to the fabric which causes the stain to migrate into another absorbent towel placed under the fabric. This technique has utility in some cases, but can leave visible staining material behind. In any event, it is generally unsuitable for use with upholstered furniture.

Another approach is to apply a cleaning solution to a stained area of the fabric, and then to rub the solution into the stain in order to mobilize it and disperse it across a larger area of the fabric. The fabric is then allowed to dry. In this techniques much of the staining material stays behind, albeit it is dispersed so that it is much less visible. This approach has been applied to fresh stains using towelettes that are pre-moistened with a cleaning solution. Such a cleaning solution typically has 3.5%–4.0% surfactant, a few percent of volatile solvents such as alcohols and glycol ethers, over 90% water, and a few other ingredients such as fragrances and preservatives.

Unfortunately, this approach can leave a visible ring at the outer periphery of the cleaning solution dispersion on the fabric, even when the main stain has been adequately cleaned. This problem is particularly troubling for stains containing oils (e.g. salad dressing stains).

In unrelated contexts (e.g. window glass cleaners containing ammonia), cleaning solutions have previously been formulated containing very low surfactant levels.

It can thus be seen that there is a need for an improved fabric wipe.

BRIEF SUMMARY OF THE INVENTION

In one aspect the invention provides a method for cleaning a stain spot that is located at a position on a fabric. A wiping applicator has been impregnated with a cleaning solution. The cleaning solution contains water, a volatile agent selected from the group consisting of alcohols, glycols, glycol ethers, and glycerine (mixtures thereof are preferred), and less than 1% by weight surfactant.

The applicator is made to contact the spot so as to transfer some cleaning solution from the wiping applicator to the spot. The cleaning solution then migrates outwardly from the spot to disperse the spot on the fabric. A volatile portion of the cleaning solution then evaporates from the fabric. Optionally, the cleaning solution may contain a fragrance, a preservative a pH buffer, and at very low concentrations (e.g. 0.5% or less) water insoluble solvents such as mineral spirits, tetradecene, and d-limonene.

The cleaning solution may also contain an enzyme selected from the group consisting of protease and lipase. By including these enzymes, the stain can be pretreated for later conventional washing (e.g. any remnants of the stain will not set into the fabric as well if the enzymes are present).

After the method is performed, the fabric does not have a readily visible ring around the position that the spot had occupied prior to the method. By readily visible we mean not visible to the unaided adult eye (a majority out of ten randomly chosen adults) from 18" away under average daylight (see generally ASTM D4265, note 6).

For particularly difficult spots, a paper towel or other separate cloth can be used to remove excess stain residue from the spot before beginning the method, and one can then rub the applicator on the spot in a generally spiral motion beginning at the outside of the stain and working towards the center. For best results, it is preferred that the spot be cleaned while it is still fresh.

The invention is suitable for removing spots from clothing and upholstery fabric. It should also be useful in connection with other types of fabrics (e.g. carpets; drapes).

A wide variety of stains can be cleaned using the methods of the present invention. These include, without limitation, those caused by foods, beverages, plants (e.g. grass) and soil/dirt stains. Other organic and inorganic stains are also intended to be encompassed within the phrase "stain spot". This technique is particularly useful on stains caused by edible oils such as cooking oil, and/or by food stains caused by very oily materials such as Italian dressing.

The wiping applicator is preferably a towelette, although the wiping applicator can instead be in various other forms so long as the wiping applicator includes a substrate from which cleaning solution may be readily transferred to a fabric to be cleaned. For example, a daubing applicator having a daubing pad can be used. Daubing applicators well known to the art include bottles having caps that include a pad that is directly wettable by the contents of the bottle.

The preferred towelette may be made of any material capable of serving as the vehicle for the cleaning solution. However, it is preferably sufficiently resistant to abrasion that it can be rubbed on a fabric without crumbling or leaving lint. Polymeric woven and non-woven fabrics are thus preferred. Rayons, nylons and polyesters are especially preferred. One non-woven rayon towelette was made from a carded, non-woven 80% rayon/20% acrylic latex chemical binder fabric. Such a towelette base (without the cleaning solution) is commercially available from Fort Howard Corporation, Green Bay, Wis. as Grades 971 and 980. Another towelette could be formed from rayon-regenerated cellulose.

It has surprisingly been learned that a large portion of the material constituting the visible ring that is present when using other dispersion spot cleaners is the residue of the cleaning solution itself (rather than an outer wave of staining material). In the present methods, very low concentrations of surfactant are used, and the pH of the cleaning solution is carefully regulated. In this regard, the cleaning solution has less than 1% surfactant and preferably a pH of between 5.5 and 7.0. A surfactant concentration between 0.0001 and 1% is preferred.

In other preferred formulations, soil release polymers are also added. Traditionally, a soil release polymer is a polymer that, when allowed to coat a fiber, aids in the release of subsequently applied soils. In the method of the invention, such polymers are applied subsequent to soiling and aid in the removal of soils already in place on the fiber, presumably by the displacement of such soils. Ethoxylated polyesters are preferred such as Sokalan HP-22 (available from BASF). Other soil releasing ethoxylated polyesters are those sold under the name ALCO Alcosperse 745.

Still other soil release polymers are available from Rhone-Poulenc under the names Repal-O-Tex QCF, QCL, QCS, QCX and SRP. They are water dispersible/water soluble nonionic polyester condensation polymers of polyethylene oxide and dicarboxy anhydrides.

The surfactant can be selected from a wide variety of anionic, cationic, nonionic, and/or zwitterionic surfactants. Preferably, low foaming surfactants are chosen. Examples of these are described in U.S. Pat. No. 4,448,704.

Particularly preferred are the anionic surfactants such as the sulfonates (e.g. sodium dodecyl benzene sulfonate). Another preferred anionic surfactants is sodium lauryl ether sulfate.

The cleaning solution contains mostly water (e.g. preferably upwards of 90%). This is because many food and beverage stains are water soluble.

The volatile cleaning agents together will collectively be in the 1%–20% (preferably 3%–10%) range. The preferred glycol ethers are the ethylene glycol ethers (such as those sold as part of the Dowanol series by Dow Chemical) and propylene glycol ethers which are also sold as the Dowanol series by Dow Chemical.

The preferred alcohols are organic alcohols having ten carbons or fewer (especially the highly volatile, low molecular weight alcohols such as ethanol, isopropanol, butanol and t-butyl alcohol).

The preferred glycols are those containing ten carbons or less such as ethylene glycol, propylene glycol, butylene glycol, and hexylene glycol.

These solvent, cleaning agents are highly volatile. Thus, the applicator should be stored in a sealed container prior to use. A preferred container is a sealed pouch. See e.g. the pouch structure of U.S. Pat. No. 4,409,116. Such a pouch can be carried conveniently by a traveler or diner and thus be available in case of accidents. Because it is particularly important that the stain be treated while it is still fresh in order for the present methods to be most effective, the convenience of a pouch is important.

In another aspect, the invention provides a wiping applicator for use in the above methods. The applicator is impregnated with the above cleaning solution.

A primary object of the invention is to provide methods for using a fabric wipe which permit the cleaning or visual alleviation of fabric stains without leaving rings that are owing to the cleaning solution.

Another object is to provide a method of the above kind that can be used without automated washers or dryers.

Another object is to provide wipes of the above kind that are portable, inexpensive, and especially effective on oily stains.

A further object is to provide fabric wipes that can clean stains on dark fabric clothing or upholstery without adversely affecting the color of most clothing and upholstery.

Yet another object of the present invention is to provide fabric wipes of the above kind that are effective on fleshly made, water-based stains.

Still other objects and advantage of the present invention will become apparent from examination of the specification and claims which follow.

DETAILED DESCRIPTION OF THE INVENTION

A first example of a cleaning solution useful with the fabric wipes of the present invention is:

EXAMPLE 1

| | | |
|---|---|---|
| deionized water | 92.79% | solvent |
| isopropanol | 3.50% | volatile cleaning agent |
| ethylene glycol mono-butyl ether | 1.00% | volatile cleaning agent |
| ethylene glycol N-hexyl ether | 0.90% | volatile cleaning agent |
| propylene glycol | 1.00% | volatile cleaning agent |
| sodium dodecyl benzene sulfonate | 0.08% | surfactant |
| sodium citrate | 0.33% | builder, pH buffer |
| Sokalan HP-22 (20% active) | 0.30% | soil release polymer |
| Takasago RI-1561/2 | 0.10% | fragrance |

A second example of a cleaning solution useful with the fabric wipes of the present invention is:

EXAMPLE 2

| | | |
|---|---|---|
| deionized water | 92.63% | solvent |
| isopropanol | 3.50% | volatile cleaning agent |
| ethylene glycol mono-butyl ether | 1.00% | volatile cleaning agent |
| ethylene glycol N-hexyl ether | 0.90% | volatile cleaning agent |
| propylene glycol | 1.00% | volatile cleaning agent |
| sodium dodecyl benzene sulfonate | 0.08% | surfactant |
| Proxel GXL | 0.10% | preservative |
| sodium citrate | 0.34% | builder, pH buffer |
| Sokalan HP-22 (20% active) | 0.30% | soil release polymer |
| d-Limonene | 0.15% | solvent/fragrance |

The Proxel GXL of Example 2 is a preservative available from Zeneca. Another suitable preservative is Kathon CG-ICP from Rohm & Haas.

5"×6" cutouts of Fort Howard 80/20 rayon/acrylic latex non-woven material can be submerged for ten seconds in a container filled with one of the above cleaning solutions. The towelettes can then be plucked from the bath and permitted to briefly drip off. They can then placed in air tight containers until testing.

Alternatively, 3 grams of the cleaning solution can be placed in a pouch with a 5"×6" swatch of the non-woven material. The pouch can then be sealed until use.

Towelettes so made were used for the following tests. Textile testing swatches were made of cotton or cotton/polyester blend. The fabrics were either white or medium blue. They were pre-stained with various food and beverage products. After removal of gross remaining food product with a napkin or paper towel (e.g. pieces of spaghetti were removed when spaghetti was the staining material), the swatches were treated with the wipes. After such treatment, the stains were permitted to dry. The textiles were examined by a panel of judges and evaluated on stain removal and ring visibility.

A very oily stain that had a very significant ringing problem on darker fabrics (e.g. Italian salad dressing) showed a sharp reduction in visible ringing when the present product was used (in comparison to a commercially available fabric wipe).

What has been described above are the preferred embodiments of the present invention. Other embodiments are also within the intended scope of the claims. For example, the applicator may be a dauber that feeds fluid to a pad (similar to a shoe polish dispenser). Further, the formulation of the cleaning solution may be changed to other formulations. As such, the claims which follow should be looked to in order to judge the full scope of the invention.

Industrial Applicability

The invention provides methods of cleaning stains on fabrics (especially darker colored fabrics) with reduced residual ringing.

We claim:

1. A method for cleaning a stain spot located at a position on a fabric, comprising:

providing a wiping applicator impregnated with a cleaning solution, the cleaning solution comprising water, a volatile agent selected from the group consisting of alcohols, glycols, glycol ethers, and glycerine, and between 0.0001% and 1% by weight surfactant; and causing the applicator to contact the spot so as to transfer some of the cleaning solution from the wiping applicator to the spot; and allowing cleaning solution to migrate outwardly from the spot to disperse the spot on the fabric; and then allowing a volatile portion of the cleaning solution to evaporate from the fabric;

wherein the method does not involve the use of an automated washer or dryer.

2. The method of claim 1, wherein the fabric to be cleaned is selected from the group consisting of clothing and upholstery fabric; and whereby after the method is performed the fabric does not have a readily visible ring around the position that the spot had occupied prior to performing the method.

3. The method of claim 1, wherein the wiping applicator is in the form of a towelette.

4. The method of claim 3, wherein the towelette is formed from a synthetic polymer.

5. The method of claim 1, wherein the surfactant is an anionic surfactant.

6. The method of claim 1, wherein the step of providing a wiping applicator includes providing the wiping applicator stored in an air tight container and removing the wiping applicator from the container for use.

7. The method of claim 6, wherein the container is a sealed pouch.

8. The method of claim 1, wherein the cleaning solution also comprises an enzyme.

9. The method of claim 8, wherein the enzyme is selected from the group consisting of lipase and protease.

10. The method of claim 1, wherein the stain spot comprises an oil, and the fabric to be cleaned is other than only white.

11. A method for cleaning a stain spot located at a position on a fabric, comprising:

providing a wiping applicator impregnated with a cleaning solution, the cleaning solution comprising water, a volatile agent selected from the group consisting of alcohols, glycols, glycol ethers, and glycerine, and between 0.0001% and 1% by weight surfactant;

causing the applicator to contact the spot so as to transfer some of the cleaning solution from the wiping applicator to the spot;

allowing cleaning solution to migrate outwardly from the spot to disperse the spot on the fabric; and then allowing a volatile portion of the cleaning solution to evaporate from the fabric;

wherein the cleaning solution has a pH of between 5.5 and 7.0 and also comprises an ethoxylated polyester.

12. A wiping applicator for use in the method of claim 5, wherein the applicator comprises a polymer towelette impregnated with the claim 5 cleaning solution.

13. The applicator of claim 12, wherein the polymer is rayon.

* * * * *